United States Patent [19]

Warren

[11] 4,147,476

[45] Apr. 3, 1979

[54] PUMP ASSEMBLY FOR AN ATOMIZING PISTON PUMP

[75] Inventor: William E. Warren, Cuffley, England

[73] Assignee: Bespak Industries Limited, England

[21] Appl. No.: 879,521

[22] Filed: Feb. 21, 1978

Related U.S. Application Data

[63] Continuation of Ser. No. 560,899, Mar. 21, 1975, abandoned.

[30] Foreign Application Priority Data

Mar. 28, 1974 [GB] United Kingdom ..... 13789/74

[51] Int. Cl.[2] ..... F04B 17/00

[52] U.S. Cl. ..... 417/328; 141/117; 222/321; 417/445; 417/545

[58] Field of Search ..... 417/328, 444, 445, 545, 417/549, 511, 514, 487, 488, 259–262; 222/321, 571; 141/116, 117

[56] References Cited

U.S. PATENT DOCUMENTS

| | | | |
|---|---|---|---|
| 3,159,316 | 12/1964 | O'Donnell et al. | 222/321 |
| 3,185,354 | 5/1965 | Lipman | 222/321 |
| 3,228,570 | 1/1966 | Steiman | 222/321 |
| 3,228,571 | 1/1966 | O'Donnell et al. | 222/321 |
| 3,331,559 | 7/1967 | Fedit | 222/321 X |
| 3,362,344 | 1/1968 | Duda | 222/321 X |
| 3,399,836 | 9/1968 | Pechstein | 222/321 X |

FOREIGN PATENT DOCUMENTS

| | | | |
|---|---|---|---|
| 753835 | 10/1952 | Fed. Rep. of Germany | 417/259 |
| 2330138 | 6/1973 | Fed. Rep. of Germany. | |

*Primary Examiner*—William L. Freeh
*Assistant Examiner*—Edward Look
*Attorney, Agent, or Firm*—Beveridge, De Grandi, Kline & Lunsford

[57] ABSTRACT

A pump assembly for an atomizing piston pump comprises a first piston slidably located in a first cylinder to define a first variable volume space and a second piston of smaller piston area than the first slidably located in a second cylinder to define a second variable volume space. The two volume spaces are in communication and there is a fluid flow passage through the first piston. A first valve is provided for opening and closing the passage and first biasing means urges the valve into a position closing the passage. Second biasing means urges the second piston towards a position corresponding to the minimum volume of the second volume space. The valve opens in the direction of fluid flow through the passage and fixed means are provided for opening the valve only after a predetermined amount of movement of the first piston.

21 Claims, 3 Drawing Figures

PUMP ASSEMBLY FOR AN ATOMIZING PISTON PUMP

This is a continuation, of application Ser. No. 560,899 filed Mar. 21, 1975 now abandoned.

BACKGROUND OF THE INVENTION (a) Field of the Invention

This invention relates to a pump assembly for an atomizing piston pump and more particularly concerns a pump assembly for an atomizing piston pump of the kind comprising a first piston slidably located in a first cylinder to define a first variable volume space, a second piston slidably located in a second cylinder to define a second variable volume space in communication with the first space, a fluid flow passage through the first piston, first valve means for opening and closing the passage, first biasing means urging the first valve means into a position closing the passage, and second biasing means urging the second piston towards a position corresponding to the minimum volume of the second space.

(b) Prior Art

This type of pump assembly is known, for example, from British Pat. No. 1136848. Known pumps however, have the disadvantage that the first valve means when opened has no means to maintain it open and this can lead to an uneven flow of the contents out of the pump, as the valve opens and closes due to fluctuating pressure in the cylinders. Incomplete atomization and the formation of droplets, particularly when the piston handle is released, are another possible disadvantage.

It is also known, for example from British Pat. No. 1051552, to have a liquid dispensing pump with a single cylinder and piston in which the flow-controlling valve is opened immediately the operating handle is depressed. This type of pump also has the disadvantage that the flow of contents from the pump tends to be uneven, since the valve is open at all times when the operating handle is depressed and the flow of contents is therefore largely controlled by the pressure applied to the handle by the operator.

It is therefore an object of the present invention to provide a pump assembly which avoids or reduces these disadvantages and provides a flow of contents from the pump at constant or very nearly constant pressure.

SUMMARY OF THE INVENTION

The invention provides a pump assembly of the kind described in which the first valve means opens in the direction of fluid flow through the first piston, and in which fixed means is provided for opening the first valve means after a predetermined amount of movement of the first piston.

Preferably said fixed means maintain the first valve open at the start of the return stroke of the pistons so that excess product is sucked back from the fluid flow passage.

The two cylinders are preferably arranged co-axially and may be directly in series with the whole area of the second cylinder leading into the first cylinder.

Preferably the pump assembly further comprises a fluid inlet at the end of the second cylinder remote from the first cylinder and second valve means opening in the direction of fluid flow and associated with the second piston for isolating the inlet from the second variable volume space.

In one embodiment of the invention the two cylinders may have the same outer diameter and the fixed means may comprise a cylindrical member extending co-axially within the second cylinder over its entire length so that the second cylinder has a smaller cross-sectional area than the first cylinder.

The second valve means may comprise an annular collar formed on the second piston, the collar acting as a seal in the upstream direction and opening in the direction of fluid flow through the pump.

Preferably there is spacing means for maintaining a certain minimum distance between the first and second pistons, said spacing means comprising a cylindrical tubular extension of the second piston, formed co-axially and integrally with the second piston and extending in the direction of fluid flow.

Preferably a first piston includes two oppositely acting annular deformable collars, for sealing against the cylinder wall and formed integrally with the first piston.

In another embodiment of the invention the first valve means includes an axial extension and a striker plate comprising two fingers extending radially of the extension, and the fixed means comprises a shoulder formed at the junction between the first and second cylinders, the arrangement being such that the striker plate co-operates with the shoulder to open the first valve means after a predetermined amount of movement of the first piston.

Preferably a bore extends through the second piston and the second valve means comprises a valve element co-operable with a valve seating formed by a shoulder in the bore.

Preferably there is spacing means for maintaining a certain minimum distance between the first and second pistons, said spacing means comprising a cylinderical tubular extension of the first piston formed co-axially and integrally with the first piston and extending towards the second piston, said tubular extension having slots formed in the wall thereof through which the fingers of the striker plate project.

There may be an annular deformable collar formed integrally with each of the first and second pistons for sealing against the cylinder wall.

In both embodiments of the invention, there may be a closure member for closing off the end of the first cylinder remote from the second cylinder.

Preferably an axial extension of the first piston extends through a hole in the closure member and terminates in an operating handle for the pump assembly, and preferably the fluid flow passage extends through the axial extension of the first piston and communicates with a rifled nozzle in the operating handle, the axis of said nozzle extending perpendicular to the axis of the extension of the first piston.

There may be a sealing washer which fits around the tubular extension of the first piston, above the first piston for sealing against the closure member when the pump assembly is not in use to prevent leakage through the pump assembly.

Finally the first and/or the second biasing means may be helical compression springs.

DESCRIPTION OF THE PREFERRED EMBODIMENTS

Figure 1:
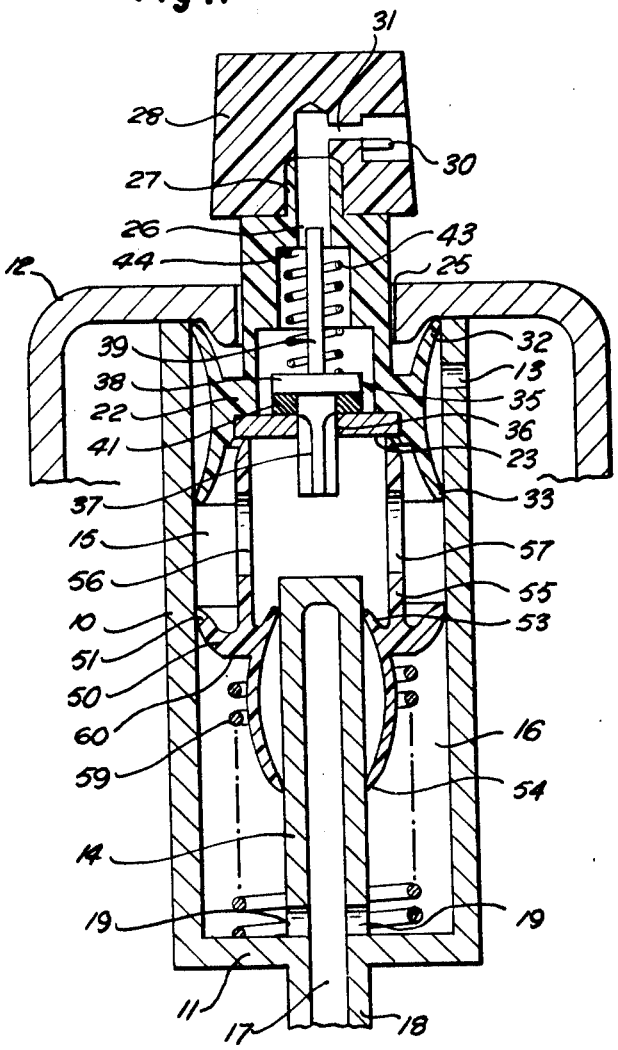
FIG. 1 is a longitudinal section of a first embodiment of atomizing piston pump.

Referring to FIG. 1, a main cylinder housing 10 has a base 11 and is closed off at its top end by a cover 12 which may be attached to a container (not shown).

An axial hollow cylindrical pedestal 14 extends upwardly from the base of the housing 10 into the housing to define two cylinders of different cross-sectional area within the housing. The upper cylinder 15 which is the part of the cylinder housing above the pedestal 14 has a larger cross-sectional area than the lower cylinder 16, which is the part of the cylinder housing surrounding the pedestal 14.

An air vent hole 13 is formed in the wall of the upper cylinder 15.

A further annular extension 18, co-axial with the pedestal 14 extends downwardly from the base 11 of the housing. An induction pipe (not shown) is attached to the extension 18 to allow the contents of the container to flow into the lower cylinder 16 via a hole 17 in the base 11 and apertures 19 in the wall of the pedestal 14.

An upper piston 22 is slidably located in the upper cylinder 15. The upper piston 22 is substantially hollow and has a closure plate 23 attached to its lower part. The upper piston 22 extends upwardly through a central aperture 25 in the cover 12 and terminates in a cylindrical boss 27 of greatly reduced diameter. An operating button 28 is mounted on the boss 27 of the upper piston 22. A radially directed rifled (or atomizing) nozzle 30 communicates with a fluid flow passage 26 in the upper cylinder via a passage 31.

The upper pistion 22 is formed with two annular deformable collars 32, 33. Collar 33 is arranged to press outwardly against the cylinder wall 10 to seal the upper piston 22 against the cylinder housing 10. Collar 32 seals against the closure member 12 when the piston is in its uppermost position between periods of operation. In this position, collar 32 also closes off the air vent hole 13 to prevent flow of air from the atmosphere to the interior of the container.

A valve 35 opening in the direction of flow is located within the substantially hollow upper piston 22 and acts against the closure plate 23 to seal a central aperture 36 in the plate 23. The valve 35 comprises a lower part 37 of Y-shaped cross-section which fits in the aperture 36, a central flange 38 to seal off the aperture 36 and an upper guide rod 39. A sealing washer 41 fits around the lower part 37 below the flange 38 to seal the valve against the closure plate 23, and the valve is normally kept closed by the action of spring 43 located around the guide rod 39 between the upper side of the flange 38 and a shoulder 44 in the upper piston 22.

A lower piston 50 surrounds the cylindrical pedestal 14 and is slidably located between the pedestal and the cylinder wall. The lower piston 50 is formed with a deformable annular outer collar 51 which seals the lower piston against the cylinder wall and acts as a valve opening in the direction of flow.

The inner part of the lower piston is formed with a deformable collar 53, which seals the lower piston against the pedestal 14, and a further collar 54 which acts as a guide element.

A cylindrical spacing member 55 extends between the upper and lower pistons to ensure that there is maintained a predetermined minimum distance between the two pistons. The spacing member 55 has apertures 56, 57 in its wall to allow the contents of the container to flow freely past the spacing member and the spacing member 55 is firmly secured to the lower piston 50. The spacing member 55 may be integral with the lower piston 50.

A spring 59 is located between a shoulder 60 on the lower side of the lower piston 50 and the base 11 of the housing, to urge the lower piston 50 into its uppermost position.

The invention is not limited to the construction described above and various modifications may be introduced. For instance the valve formed by the outer collar of the lower piston may be replaced by a one-way valve mounted in the upper part of the pedestal 14. In this case a double collar may be formed on the outer part of the lower piston to seal the lower piston against the cylinder wall.

Furthermore the valve 35 may be replaced by a simple valve and tension spring arrangement or any other suitable valve which opens in the direction of fluid flow through the first piston.

In operation, the operating button 28 is depressed to move downwardly the two pistons 22, 50 and the valve 35. The pressure produced by the fluid trapped between the two pistons and induced by the pressure of spring 59 maintains the annular collar 51 pressed outwardly against the cylinder wall while the valve 35 is kept closed by the spring 43. Owing to the fact that the lower cylinder 50 is of smaller cross-sectional area than the upper cylinder 22, the stroke of the lower piston is greater than the stroke of the upper piston, and the pressure of the spring 59 is supported by the fluid pressure.

After the upper piston has been depressed by a predetermined distance, the bottom of the part 37 comes into contact with the top of the pedestal 14. Continued depression of the upper part causes the valve 35 to start to open, and it is natural for the depression to be continued until it comes to a stop, at which point the valve 35 is fully open. The spring 59 then causes the lower piston to start to move upwards and part of the contents of the cylinders are expelled through the aperture 36 past the cut-away portions of the part 37 and thence through the passages 26, 31 to the nozzle 30.

When the operating handle is released the pistons start to move upwards on the induction stroke. However since the lower part 37 of the first valve is still in contact with the pedestal 14, the valve 35 remains open for the first part of the induction stroke. The upward movement of the pistons with the valve 35 open induces a suck-back action which allows any product remaining in the passages 26, 31 and the nozzle 30 to be sucked-back into the space between the two pistons. This action prevents any dripping after the handle is released, and is an important feature of the present invention.

As the spring 59 continues to push the lower piston upwards, product from the container (not shown) flows up the induction pipe (not shown) via the hole 17 and apertures 19 and past the collar 51. Thus, at the end of the induction stroke, the enlarged volume between the pistons remains filled with product and the operating cycle may be recommenced.

The contents of the container are not under pressure but if any pressure build-up does occur in the container due to extraneous factors, the pressure build-up will force product past the collar 51 and will open the valve 35. This will allow the product to vent to the atmosphere and thus the valve 35 also acts as a safety-valve.

Figure 2:
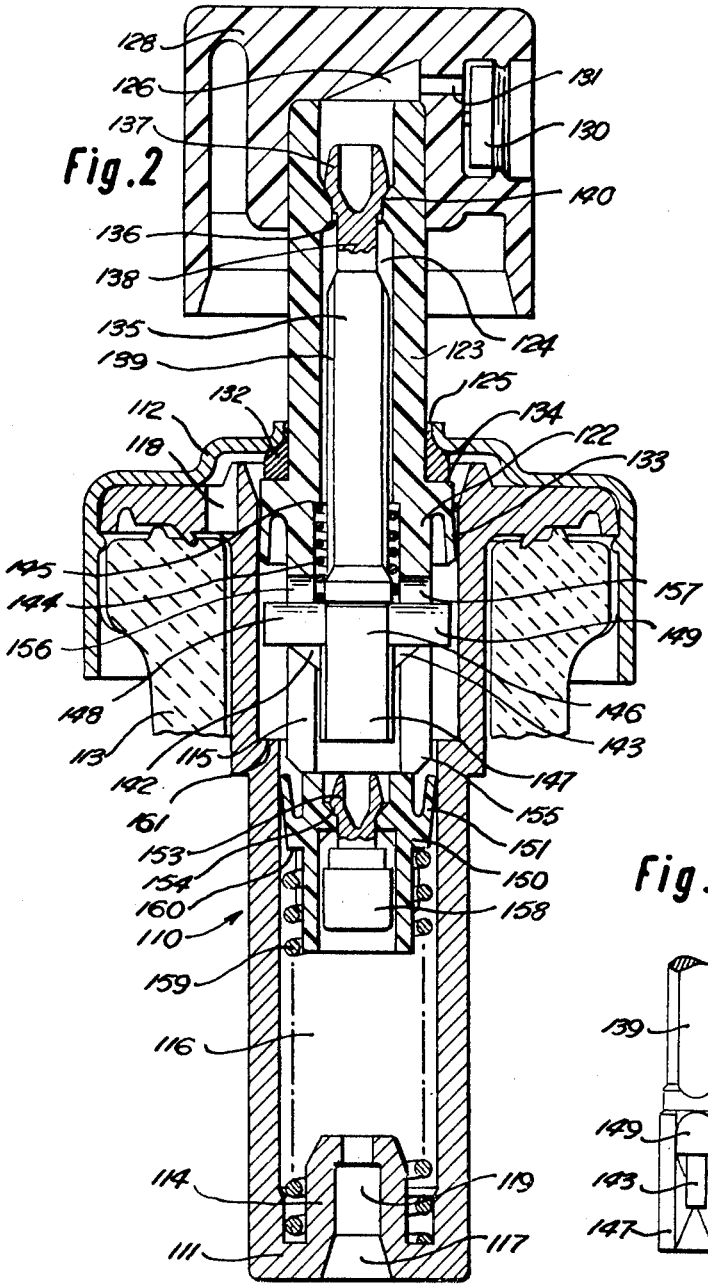
FIG. 2 is a longitudinal section of a second embodiment of atomizing piston pump.
Figure 3:
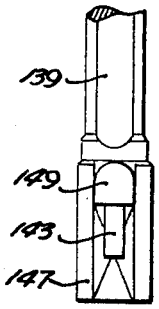
FIG. 3 is an enlarged detail of FIG. 2.

Referring now to FIGS. 2 and 3 which show a second embodiment of pump assembly a cylinder housing 110 has a base 111 and is closed off at its top end by a cover 112 which may be attached to a container, part of which is indicated by 113.

An air vent hole 118 is provided in the upper part of the housing 110.

The housing 110 defines an upper cylinder 115 and a lower cylinder 116 which has a smaller cross-sectional area than the upper cylinder.

A hollow pedestal 114 is formed in the base of the housing 110 and is in communication, via a hole 117 in the base 111, with the interior of the container. A dip tube (not shown) may be attached to the base 111 below the hole 117 so that the contents of the container may flow into the lower cylinder 116 via the hole 117 and passage 119 in the pedestal 114.

An upper pistion 122 is slidably located in the upper cylinder 115, and has a hollow cylindrical extension 123 which extends through a central aperture 125 in the cover 112. A fluid flow passage 124 extends through the upper piston 122 and the extension 123.

An operating button 128 is mounted on the extension 123 and includes a radially directed rifled (or atomizing) nozzle 130 which communicates with the fluid flow passage 124 via fluid flow passages 126 and 131 in the operating button 128.

The upper piston 122 is formed with a downwardly directed annular deformable collar 133. Collar 133 is arranged to press outwardly against the cylinder housing wall 110 to seal the upper piston 122 against the housing.

The upper piston 122 also has a sealing washer 132 which fits around the cylindrical extension 123 and is seated on a shoulder 134 of the piston 122 from which the collar 133 depends. The sealing washer 132 seals against the underside of the cover 112 when the upper piston 122 is in its uppermost position to prevent product leaking through the hole 125 and via hole 118 to the exterior of the container, in the event of the container being significantly tilted.

An annular protrusion 140 is formed on the inner wall of the cylindrical extension 123 and provides a valve seating for a valve element 135, which opens in the direction of flow. The valve element 135 comprises an upper resilient portion 137 which seals against the seating 140, a neck portion 138 of reduced diameter which is slidable through the orifice 136 formed by the valve seating and a stem portion 139.

A striker plate 146 is rigidly attached to the lower end of valve stem 139 and may be formed integrally therewith. The striker plate 146 comprises two fingers 148, 149 which extend radially outwardly from a central depending member 147, and are strengthened by webs 142, 143. The striker plate is seen more clearly in FIG. 3.

The valve 135 is normally kept closed by the action of a helical compression spring 144 which is located around the valve stem 139 between the upper side of the fingers 148, 149 and a shoulder 145 formed in the fluid flow passage 124.

A cylindrical spacing member 155 extends downwardly from the upper piston 122 and has slots 156, 157 in its side walls to allow the contents of the container to flow freely past the spacing member. The spacing member 155 is integral with the upper piston 122. The fingers 148, 149 of the striker plate are slidingly engaged in the slots 156, 157 respectively and extend therethrough.

A lower piston 150 is slidably located in the lower cylinder 116 and is maintained at a predetermined minimum distance from the upper piston 122 by the spacing member 155.

An upwardly directed deformable annular outer collar 151 is formed at the upper part of the lower piston 150 and seals the lower piston against the cylinder housing wall 110. The lower piston 150 is substantially hollow and a second valve element 153 is located within the lower piston 150 and acts against a seating 154 formed by an annular abutment within the lower piston to seal off the space above piston 150 from the passage 119. Valve 153 opens in the direction of flow. The valve element 153 includes a portion 158 of increased diameter which limits the travel of valve element 153 upwardly with respect to the valve seating.

A spring 159 is located between a shoulder 160, formed on the lower side of the upper part of piston 150, and the base 111 of the housing. the spring 159 normally urges the lower piston 150 into its uppermost position, and the force is taken through the piston 150, spacer 155 and piston 122 to the sealing washer 132.

The junction between the two cylinders 115 and 116 forms a shoulder 161 and the side arms 148, 149 of the striker plate 146 are sufficiently along that they engage the shoulder 161 if the upper piston is moved downwardly far enough.

The upper and lower pistons 122, 150, the spacer 155, the first and second valves 135, 153 and the striker plate 146 are all co-axial.

In operation, the operating button 128 is depressed to move downwardly the two pistons 122, 150 and the valve 135. The pressure produced by the fluid trapped between the two pistons and induced by the pressure of spring 159 maintains the annular collar 151 pressed outwardly against the cylinder wall and the valve 153 closed, while the valve 135 is kept closed by the spring 144. Owing to the fact that the lower cylinder 150 is of smaller cross-sectional area than the upper cylinder 122, the stroke of the lower piston is greater than the stroke of the upper piston, and the pressure of the spring 159 is supported by the fluid pressure.

After the upper piston has been depressed by a predetermined distance, the side arms 148, 149 of the striker plate 146 come into contact with the shoulder 161. Continued depression of the upper part causes the valve 135 to start to open, and it is natural for the depression to be continued until it comes to a stop, at which point the valve 135 is fully open. The spring 159 then causes the lower piston to start to move upwards and part of the contents of the cylinders are expelled through the orifice 136 past the valve portion 137 and thence through the passages 126, 131 to the nozzle 130.

When the operating handle is released the pistons start to move upwards on the induction stroke. However since the side arms 148, 149 of the striker plate 146 are still in contact with the shoulder 161, the valve 135 remains open for the first part of the induction stroke. The upward movement of the pistons with the valve 135 open induces a suck-back action which allows any product remaining in the passages 126, 131 and the nozzle 130 to be sucked-back into the space between the two pistons. This action prevents any dripping after the handle is released, and is an important feature of the present invention.

As the spring 159 continues to push the lower piston upwards, product from the container (not shown) flows up the induction pipe (not shown) via the hole 117 and passage 119 and past the valve 153. Thus at the end of the induction stroke, the enlarged volume between the pistons remains filled with product and the operating cycle may be recommenced.

The contents of the container are not under pressure but if any pressure build-up does occur in the container due to extraneous factors, the pressure build-up will force product past the second valve 153 and will also open the valve 135. This will allow the product to vent to the atmosphere and thus the valve 135 also acts as a safety-valve. The pressure at which the product will be vented to the atmosphere is determined by the strength of the spring 144.

I claim:

1. A pump assembly for an atomizing piston pump and comprising: a first cylinder; a first piston located in the first cylinder to define a first variable volume space; a second cylinder coaxial with the first cylinder and in communication therewith; a second piston of smaller piston area than the first piston slidably located in the second cylinder to define a second variable volume space, in communication with the first space; a fluid inlet to the end of the second cylinder remote from the first cylinder; a fluid flow passage through the first piston; spacing means comprising a tubular extension of the first piston formed coaxially and integrally therewith and extending towards the second piston for maintaining a certain minimum distance between the first and second pistons; first valve means for opening and closing the fluid flow passage, said valve means opening in the direction of fluid flow through the fluid flow passage; second valve means for opening and closing the fluid inlet; first biasing means urging the first valve means into a position closing the passage; second biasing means urging the second piston towards a position corresponding to the minimum volume of the second volume space; an axial extension of the first valve means; a striker plate comprising two fingers extending radially of the axial extension through slots formed in the tubular extension of the first piston; and fixed means comprising a shoulder formed at the junction of the first and second cylinders, the arrangement being such that the striker plate co-operates with the shoulder to open the first valve means only after a predetermined amount of movement greater than zero of the first piston relative to the first cylinder.

2. A pump assembly for an atomizing piston pump comprising a housing, means within said housing defining a first cylinder, a first piston having a liquid flow passage therethrough and slidably positioned in said first cylinder to vary the volume thereof, first valve means for opening and closing and liquid flow passage, first biasing means urging said first valve means to a position closing said liquid flow passage, means fixed relative to said first cylinder for opening said first valve means, said first valve means including means positioned to contact said fixed means after a predetermined amount of movement greater than zero of said first piston relative to said housing to open said first valve means against the urging of said first biasing means only after the said first piston and said first valve means have moved relative to said housing by the predetermined amount, means defining a variable volume liquid storage chamber in communication with said first cylinder on one side of said first piston, means for varying the volume of said liquid storage chamber so that the volume enclosed by said liquid storage chamber and said first cylinder on said one said of said first piston remains substantially constant during said predetermined amount of movement of said first piston, second biasing means urging said varying means into a position corresponding to the minimum volume of said liquid storage chamber, means defining a liquid inlet to said liquid storage chamber, second valve means for opening and closing said liquid inlet, and actuation means for moving said first piston toward said fixed means, whereby during each dispensing stroke, after the predetermined amount of movement of said first piston relative to said housing, said first valve means contacts said fixed means to open said liquid flow passage, allowing liquid within said first cylinder and said variable volume chamber to pass therethrough under urging of said second biasing means and said varying means.

3. A pump assembly as claimed in claim 2 in which said variable volume liquid storage chamber defining means comprises a second cylinder of smaller cross-sectional area than said first cylinder, said varying means comprise a second piston slidably located in second cylinder, said second biasing means urges said second piston towards said first piston, and said pump assembly further comprises spacing means for maintaining at least at predetermined minimum separation between said first piston and said second piston.

4. A pump assembly as claimed in claim 3 in which the fixed means maintains the first valve means open at the start of the return stroke of the pistons so that excess fluid is sucked back from the fluid flow passage.

5. A pump assembly as claimed in claim 3 in which the first and second cylinders are co-axial and are arranged directly in series with the whole area of the second cylinder leading into the first cylinder.

6. A pump assembly as claimed in claim 3 in which the liquid inlet is at the end of the second cylinder remote from the first cylinder and the second valve means opens in the direction of liquid flow and is associated with the second piston for isolating the liquid inlet from the second variable volume space.

7. A pump assembly as claimed in claim 3 in which the first and second cylinders have the same outer diameter and the fixed means comprises a cylindrical member extending co-axially within the second cylinder over its entire length.

8. A pump assembly as claimed in claim 7 in which the second valve means comprises an annular deformable collar formed integrally with the second piston.

9. A pump assembly as claimed in claim 7 in which there is spacing means for maintaining a certain minimum distance between the first and second pistons, said spacing means comprising a cylindrical tubular extension of the second piston, formed co-axially and integrally with the second piston and extending in the direction of fluid flow.

10. A pump assembly as claimed in claim 3 in which the first valve means includes an axial extension and a striker plate comprising two fingers extending radially of the extension, and the fixed means comprises a shoulder formed at the junction between the first and second cylinders, the arrangement being such that the striker plate co-operates with the shoulder to open the first valve means after a predetermined amount of movement of the first piston.

11. A pump assembly as claimed in claim 10 in which a bore extends through the second piston and the second valve means comprises a valve element co-operable with a valve seating formed by a shoulder in the bore.

12. A pump assembly as claimed in claim 10 in which the second piston includes an annular deformable collar for sealing against the cylinder wall and formed integrally with the second piston.

13. A pump assembly as claimed in claim 10 in which the first piston includes an annular deformable collar for sealing against the cylinder wall and formed integrally with the first piston.

14. A pump assembly as claimed in claim 3 further comprising a closure member for closing off the end of the first cylinder remote from the second cylinder.

15. A pump assembly as claimed in claim 14 in which the first piston includes an axial extension extending through a hole in the closure member and terminating in an operating handle for the pump assembly.

16. A pump assembly as claimed in claim 15 in which the operating handle has a rifled nozzle therein and in which the fluid flow passage extends through the axial extension of the first piston and communicates with the rifled nozzle, the axis of said nozzle extending perpendicular to the axis of the extension of the first piston.

17. A pump assembly as claimed in claim 15 further comprising a sealing washer fitting around the axial extension of the first piston, above the first piston for sealing against the closure member when the pump assembly is not in use to prevent leakage through the pump assembly.

18. A pump assembly as claimed in claim 3 in which the first and second biasing means each comprise a helical compression spring.

19. A pump assembly as claimed in claim 2 in which the first piston includes two oppositely acting annular deformable collars, for sealing against the cylinder wall and formed integrally with the first piston.

20. A pump assembly for an atomizing piston pump comprising a housing having defined therein a first cylinder of a first cross-sectional area and a second cylinder communicating with said first cylinder and of a second cross-sectional area less than the first cross-sectional area; a first piston slidably positioned in said first cylinder and having a liquid flow path therethrough; a second piston slidably positioned in said second cylinder and cooperating with said housing and said first piston to define a variable volume chamber between said first and second pistons; first valve means positioned in the liquid flow path and movable in a direction away from the variable volume chamber to open the liquid flow path; first biasing means urging said first valve means toward the variable volume chamber to close the liquid flow path; spacer means positioned between said pistons and movable independent of said first valve means for maintaining said second piston at least a predetermined minimum distance from said first piston; stop means fixed with respect to said housing for contacting said first valve means and moving said first valve means against the urging the said first biasing means only after a predetermined amount of movement greater than zero of said first piston and said first valve means to open the liquid flow path after the predetermined amount of movement; second biasing means for urging said second piston toward said first piston to tend to reduce the volume of the variable volume chamber; means defining a liquid inlet to the variable volume chamber; second valve means responsive to increased pressure in the variable volume chamber for closing the liquid inlet and responsive to reduced pressure in the variable volume chamber for opening the liquid inlet; and actuation means for moving said first piston and said first valve means toward said stop means, the arrangement being such that during each dispensing stroke after the predetermined amount of movement of said first piston and said first valve means, said first valve means contacts said stop means to open the liquid flow path, allowing liquid within the variable volume chamber to pass therethrough under the pressure of said second biasing means acting on said second piston.

21. A pump assembly for an atomizing piston pump comprising a housing having defined therein a first cylinder of a first cross-sectional area and a second cylinder communicating with said first cylinder and of a second cross-sectional area less than the first cross-sectional area; a first piston slidably positioned in said first cylinder and having a liquid flow path therethrough; a second piston slidably positioned in said second cylinder and cooperating with said housing and said first piston to define a variable volume chamber between said first and second pistons; first valve means positioned in the liquid flow path and movable in a direction away from the variable volume chamber to open the liquid flow path; first biasing means urging said first valve means toward the variable volume chamber to close the liquid flow path; spacer means positioned between said pistons and movable independent of said first valve means for maintaining said second piston at least a predetermined minimum distance from said first piston; stop means fixed with respect to said housing for contacting said first valve means and moving said first valve means against the urging of said first biasing means only after a predetermined amount of movement greater than zero of said first piston and said first valve means to open the liquid flow path after the predetermined amount of movement; second biasing means for urging said second piston toward said first piston to tend to reduce the volume of the variable volume chamber; means defining a liquid inlet to the variable volume chamber; second valve means for allowing liquid flow through the liquid inlet into the variable volume chamber; and actuation means for moving said first piston and said first valve means toward said stop means, the arrangement being such that during each dispensing stroke after the predetermined amount of movement of said first piston and said first valve means, said first valve means contacts said stop means to open the liquid flow path, allowing liquid within the variable volume chamber to pass therethrough under the pressure of said second biasing means acting on said second piston.

* * * * *